United States Patent [19]

Dhuic

[11] Patent Number: 4,474,535

[45] Date of Patent: Oct. 2, 1984

[54] AXIAL AND RADIAL HOLDING SYSTEM FOR THE ROTOR VANE OF A TURBOJET ENGINE

[75] Inventor: Jean-Claude Dhuic, Melun, France

[73] Assignee: S.N.E.C.M.A., Evry, France

[21] Appl. No.: 452,772

[22] Filed: Dec. 22, 1982

[30] Foreign Application Priority Data

Dec. 29, 1981 [FR] France ..... 81 24355

[51] Int. Cl.[3] ..... F04D 5/32

[52] U.S. Cl. ..... 416/221; 416/220 R

[58] Field of Search ..... 416/220 R, 221

[56] References Cited

U.S. PATENT DOCUMENTS

| | | | |
|---|---|---|---|
| 3,383,095 | 5/1963 | Anderson | 416/220 |
| 4,102,602 | 7/1978 | Rottenkolber | 416/221 |
| 4,208,170 | 6/1980 | Tucker et al. | 416/221 |
| 4,265,595 | 5/1981 | Bucy et al. | 416/220 |

FOREIGN PATENT DOCUMENTS

| | | |
|---|---|---|
| 2300215 | 9/1976 | France . |
| 2345605 | 6/1979 | France . |
| 2426151 | 12/1979 | France . |
| 2021206 | 11/1979 | United Kingdom . |

*Primary Examiner*—Stephen Marcus
*Assistant Examiner*—John Kwon
*Attorney, Agent, or Firm*—Oblon, Fisher, Spivak, McClelland & Maier

[57] ABSTRACT

A blade holding system including a block 13 formed of an elongated part 15 having a lengthwise slot 18 extending over virtually its entire length. The longitudinal sides 181, 182 have openings 23 that receive an axle 17 holding a flexible strip 16 partially lodged in the slot. The flexible strip has two shanks 25, 26. The end 29 of one of the shanks 26 rests on one end 21 of the elongated part 15, the end 28 of the other shank 25 juts out from the lower plane of the elongated part 15 and, when the block 13 is in place between the blade foot 6 and the dovetail groove 2, is able to rest against the bottom 14 of the groove 2.

6 Claims, 4 Drawing Figures

AXIAL AND RADIAL HOLDING SYSTEM FOR THE ROTOR VANE OF A TURBOJET ENGINE

BACKGROUND OF THE INVENTION

1. Field of the Invention

The invention concerns an axial and radial holding assembly for the rotor blade of a turbojet engine able to prevent hammering of the blade feet and the groove, and more particularly a block that can be housed between the blade foot and the bottom of the groove provided in the rim of the rotor disk.

2. Description of the Prior Art

Axial and radial holding assemblies for blades, such as that described in French Pat. No. 2 345 605, consisting of a block that is placed between the blade foot and the bottom of the groove so as to hold the upper part of the blade foot dovetailed against the side teeth of the groove, with the block being held axially by a U-shaped lock cooperating with corresponding notches provided in the blade foot and in the teeth of the groove, are well-known and the system shown therein is simple and effective. To facilitate or even make possible the assembly and dismantling of the unit, there nonetheless is some play between the block, the blade foot and the bottom of the groove (at least for most blades). This play proves to be harmful from the viewpoint of wear. Indeed, during self-rotation or low-speed rotation of the rotor, the centrifugal force exerted on the blades is no longer sufficient to keep the blade feet pressed against both oblique faces of the grooves.

With each turn, the blades go from a position of resting on one side of the seating to a position of resting on the other side. This produces chatter and, what is more serious, hammering, which does serious damage to the surfaces in contact with one another. If such hammering is difficult to accept even for parts that are easily replaceable, such as the blocks or even the blades, it is impossible for the rotor disk, for which such damage is entirely unacceptable.

Hence, French Pat. Nos. 2 300 215 and 2 426 151 offer solutions that make use of blocks having an elastic part able to maintain permanent contact between the blade foot and the groove. The block described in the first patent cited consists of three lengthwise, independent parts, two lateral parts, and one central part. The two lateral parts have on the ends of two adjacent faces a plurality of flanges provided so as to be able to press against the front or rear face of the disk, on either side of the groove and against the radial ends of the blade feet. These two symmetrical parts are introduced into the space between the blade foot and the bottom of the groove and are held apart by the central part having a shape approximately complementary to the remaining space. This part includes a housing that receives an elastic member resting against the bottom of the groove. The three parts are unitarily connected with a bolt after being put in place.

The second patent cited describes a block having two lateral parts identical to those of the preceding patent, but a central part consisting of two elements and a supplementary locking block. One of the elements forms a spacing block that can be elastically distorted in the axial plane and cooperates with a groove provided in the small bar forming the other element and is intended to be placed against the bottom of the groove. Installation of the system is achieved as in the previous case by introducing the lateral parts, the small bar, and then the spacing block. Then the locking block is placed between the ends of the small bar and the spacing block and this presses the spacing block against the small bar and the blade feet. A bolt holds the various parts together and assures locking engagement therebetween.

The elastic distortion of the spacing block, when it is in place, develops sufficient contact strength to hold the blade foot regardless of the rotor's rotation speed. The large number of parts in either of these solutions from the prior art nonetheless makes assembly and dismantling of the blades a delicate task.

SUMMARY OF THE INVENTION

The object of the present invention involves the provision of a holding assembly of the same type as those described in the prior art, but having a lesser number of parts and above all forming a unit that can be installed or removed in a single operation.

The assembly according to the invention is remarkable in that the block is formed as a unit consisting of an elongated part having a lengthwise slot extending over virtually its entire length, the lengthwise sides of the part having coaxial openings, an axle 17 passing through said openings, a flexible strip, held by said axle, housed in the slot and having in relation to the axle two shanks, the top and bottom sides of which create between them obtuse angles, with the free end of one shank supported against one end of the elongated part, and the free end of the other shank having a part able to rest on and exert radial pressure against the bottom of the dovetail groove.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
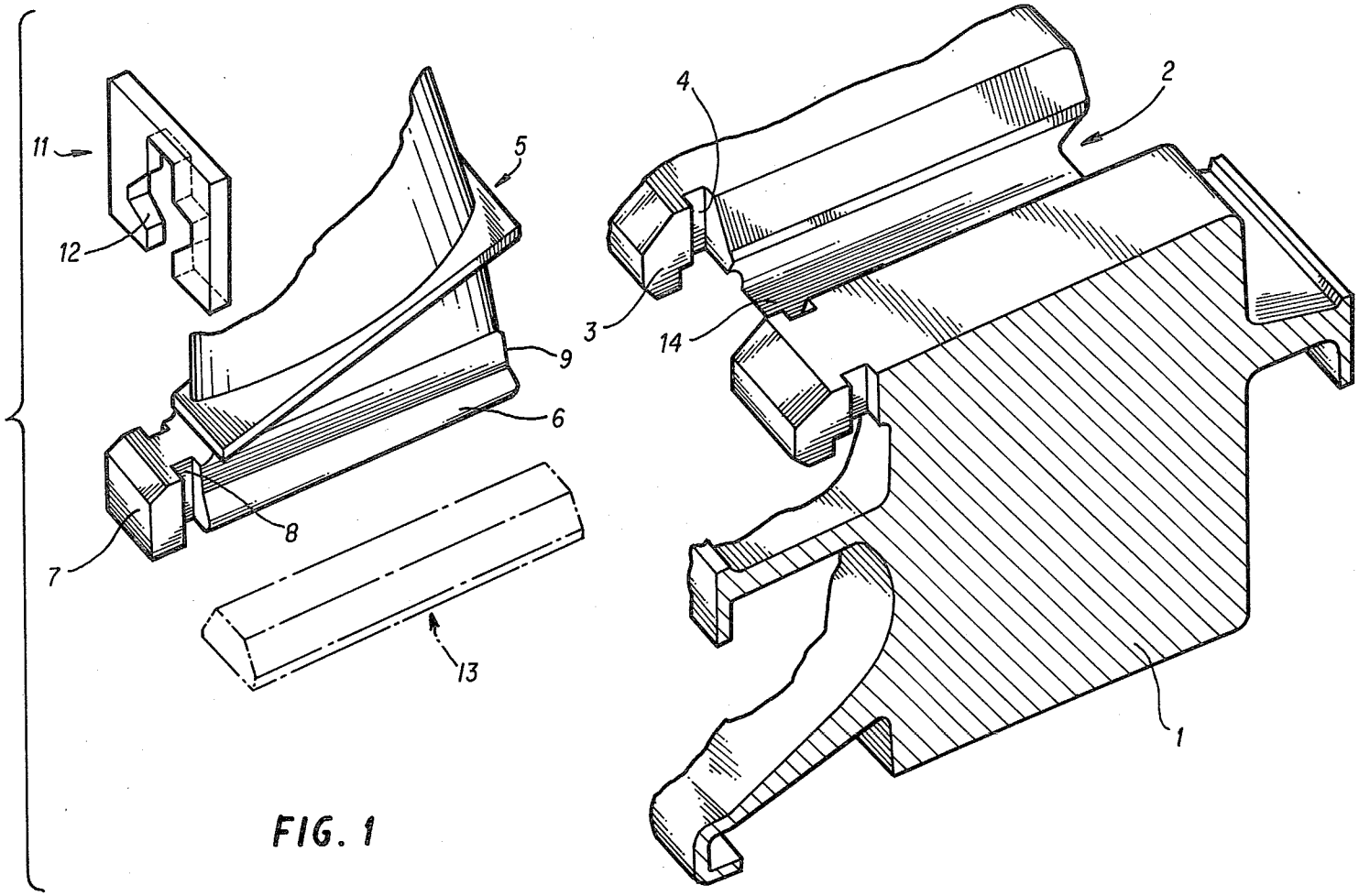
FIG. 1 shows an exploded view of a rotor blade holding assembly.

FIG. 1 shows in exploded view an axial and radial holding assembly for a rotor blade. The rotor disk 1 has formed in its rim a plurality of axial grooves 2 with a dovetail section. On the periphery of the disk 1 and perpendicular to its upstream face, a plurality of teeth 3 provided between the grooves bear notches 4 facing one another, the bottoms of which are parallel to the radial plane passing through the middle of the groove 2. The blade 5, the foot 6 of which has a dovetail shape corresponding to that of the groove 2, has an upstream extension in the shape of a flange 7, laterally bearing a plurality of notches 8.

Assembly of the blade is achieved by sliding the foot 6 in the groove 2 of the rotor disk 1. When the end 9 of the foot 6 is flush with the downstream face 10 of the disk 1, the notches 8 of the blade flange 7 are opposite the notches 4 of the neighboring teeth 3. A U-shaped lock 11, equal in thickness to the distance separating the lateral edges of the notches 4 in the teeth, has an indentation 12 the upper part of which, near the horizontal shank of the U, has a slot. The cross section of this slot corresponds to that part of the flange 7 located between the notches 8. The central part of the indentation has a cross section corresponding to the cross section of the block 13.

Assembly is achieved in accordance with the following steps. After sliding the blade foot 6 into the groove 2, the lock 11 is introduced between the notches 4 and 8 of the teeth and the blade foot 6. The lock 11 is then blocked up against the flange 7. Then the block 13 is introduced into the central part of the indentation 12 and between the blade foot 6 and the bottom 14 of the groove 2. The lock presses the dovetail part of the blade foot against the corresponding parts of the seating constituting the groove 2 in the disk 1.

Figure 2:
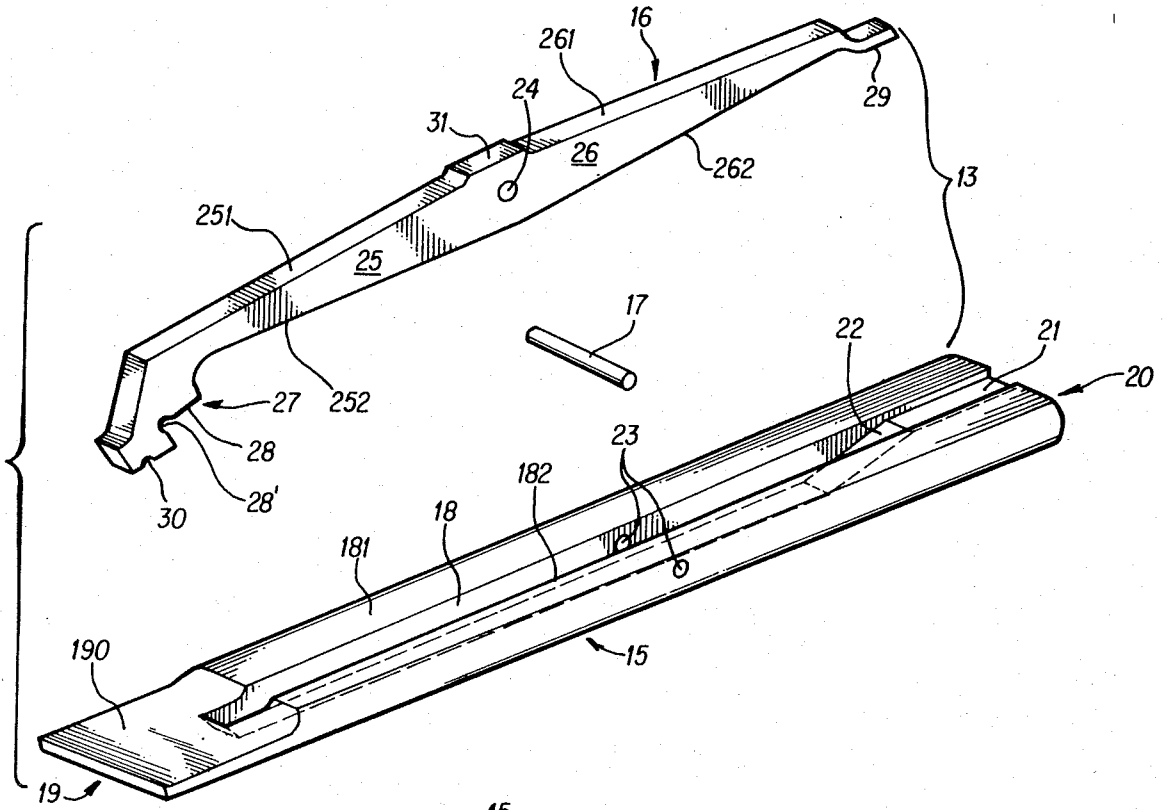
FIG. 2 is an exploded view of a block according to the invention.
Figure 3:
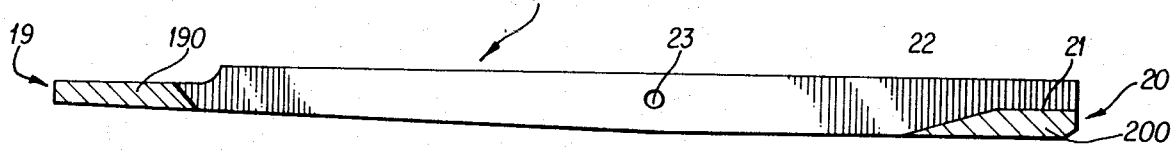
FIG. 3 is a longitudinal cross section view of an element forming the block.

According to one example of realization of the invention, the block 13 (FIG. 2) consists of three assembled elements: an elongated part 15, a flexible strip 16 and an axle 17, for which the mode of cooperation will be described below. The elongated part 15 bears in its longitudinal plane of symmetry a slot 18 extending over virtually its entire length. Two bridges 190 and 200 are formed at the front and rear ends 19, 20 of the part 15. The bridge 200 made at the rear end bears a groove 21, the bottom of which has a part approximately parallel to the lower plane of the part that can be connected to another part 22 inclined towards the inside of the slot 18 and meeting the lower plane. At the front end 19 the part has a cross section of lesser height than that of the rear end 20.

The lengthwise sides 181 and 182 of the part 15 bear two openings 23 coaxial to an axis perpendicular to the part's longitudinal plane of symmetry. The flexible strip 16 is less thick than the slit 18 and approximately equal in length to the slot and bears an opening 24 perpendicular to its longitudinal plane of symmetry. The strip 16 is formed on either side of this opening 24 by two shanks 25 and 26, the top and bottom sides of which are designated respectively by 251, 261, 252, 262 and form obtuse angles. The shank 25 bears at its free upstream end 27 an indentation 28 in the shape of a right-angled dihedron, the planes of which are connected by a rounded-off portion 28', and the end of the shank 26 has a plane boss 29. The function of the indentation 28 and boss 29 will be explained later.

The block 13 is formed by introducing the flexible strip 16 into the slot 18 in the part 15, the boss 29 of the shank 26 lying on the horizontal bottom of the groove 21, then interconnecting them by means of the axle 17 passing through the openings 23 in the block and 24 in the strip 18. In this manner the three parts 15, 16, 17 form the block 13 proper. It should be noted that the angle created by the shanks of the strip causes the end 27 to go beyond the lower plane of the block when the part 29 rests on the bottom of the groove 21.

Because the end 27 juts out, in order to introduce the block 13 between the blade foot 6 and the bottom 14 of the groove, it is necessary to force this end 27 so that it lodges in the slot 18. The end 27 of the strip 16 is held in this position by a device having means that rest on the top face 190 of the end 19 of the part 15 and engage in a notch 30 made in the lower face of the front end 27 of the flexible strip 16. The pressure exerted simultaneously on the end of the flexible strip 16 and the end of the part 15 makes it possible to partially retract inside the slot 18 the front end of the flexible strip 16.

Figure 4:
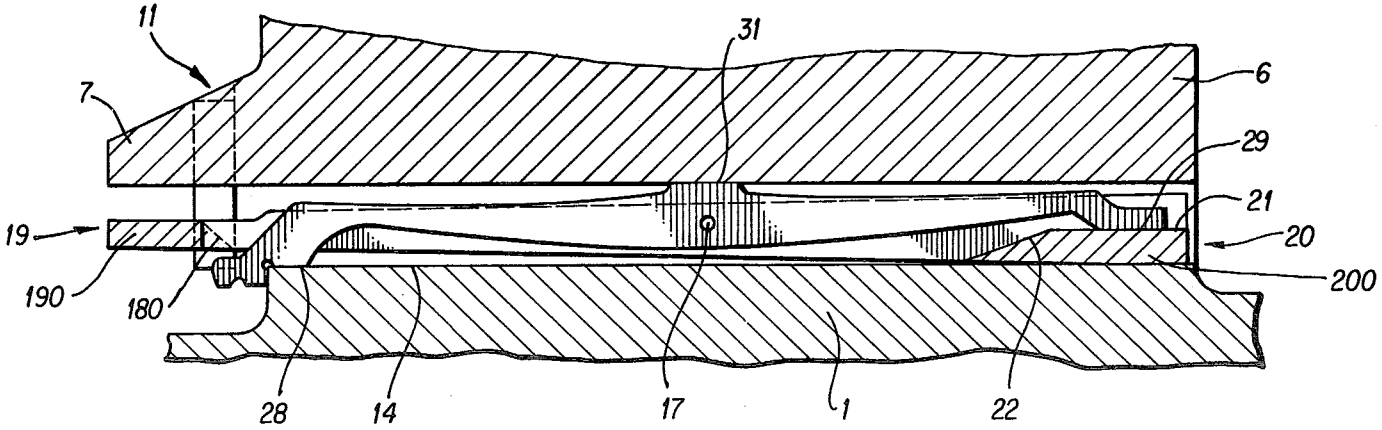
FIG. 4 is a cross section view along the radial plane passing through the middle of the groove of the holding assembly according to the invention.

In order to limit the movement of the flexible strip 16, when the part 15 and the strip 16 are pressed by a tightening device the upstream wall of the slot 18 can be slightly extended downstream along an inclined plane indicated by the dotted line 180 in FIG. 4. In fact, excessive movement towards the outside of the face 251 may make the block 13 too thick to allow it to be introduced into the groove 2 of the disk 1.

When the flexible strip 16 is thus made taut, as previously described the block 13 is introduced into the central indentation 12 of the lock 11 between the blade foot 6 and the bottom 14 of the groove 2 of disk 1. The indentation 28 in the end of the flexible strip 16 then caps off the upstream face of the rotor disk 1 through the groove 2.

The device maintaining the pressure between the part 15 and the strip 16 is then removed, which places the horizontal face of the indentation 28 against the bottom 14 of the groove 2 and the vertical face of the indentation 28 against the upstream face of the disk 1. As illustrated in FIG. 4, the block 13 is thus locked axially, from the upstream side towards the downstream side. Locking in the opposite direction, from the downstream side towards the upstream side, can be assured in a known manner by a flange of the front cap resting against the end 19 of the block 13.

When the strip 16 relaxes, it exerts a pressure against the blade foot 6 by means of a boss 31 provided on the strip plumb with the axis of rotation and on the bottom 14 of the dovetail groove 2 by the two bosses consisting of the horizontal face of the indentation 28, towards the front, on the bottom 14 of the groove 2 of the disk 1, and of the resting of the boss 29 on the part 21 of the rear end of the elongated part 15, this rear end itself resting on the bottom 14 of the groove 2 towards the rear of the disk 1.

The elasticity of the strip 16 causes the block 13 to rest (directly upstream, indirectly by means of the bridge 200 towards the rear) on the bottom of the groove 2. The upper center of the strip 16 comes to rest via a boss 31 on the lower median part of the blade foot 6, which prevents chatter.

According to one example of realization, the force exerted is then on the order of 200 daN, sufficient to prevent the blade from chattering when the rotor turns in autorotation. It would not be going beyond the scope of the invention to reverse the bearings of the block 13, particularly with two bearings of this unit on the lower part of the blade foot 6 and one bearing on the disk 1 towards the middle of the groove 2.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. An axial and radial holding assembly for the rotor blade of a turbojet engine, comprising:

a rotor disk having a rim with a plurality of grooves formed therein, the blade having a flange with a plurality of notches formed therein and a dovetail foot axially slidable in the corresponding grooves of the rim of the rotor disk, the disk having on its periphery and perpendicular to a face portion thereof a plurality of teeth within the edges of which are provided essentially radial notches opposite one another and corresponding to said notches provided in the flange of the blade;

a block disposed between the foot of said blade and a bottom portion of said groove of said disk; and a U-shaped locking member cooperating through an outside portion thereof with the notches of the teeth and having formed in a central portion thereof an indentation corresponding to the cross section of said block, said indentation extending towards a horizontal shank portion of the U-shaped locking member by a first slot the edges of which cooperate with the notches in the blade foot flange wherein said block further comprises an elongated portion having a second longitudinal slot formed therein extending over virtually the entire length thereof, lengthwise sides thereof having first and second coaxial openings formed therein, an axle disposed in said first and second openings, and a flexible strip mounted on said axle and positioned in the second slot and having first and second shanks wherein top side portions and bottom side portions of said shanks form obtuse angles, a free end portion of said first shank being positioned on a first end portion of said elongated portion and a free end portion of said second shank having a portion thereof positioned on and exerting pressure against a bottom portion of the groove of said disk.

2. An assembly according to claim 1, wherein said elongated portion further comprises a goove formed in a bottom portion of one end thereof and separate from said second slot and wherein said strip further comprises a boss at said free end portion of said first shank and disposed against one end of said block for cooperating with said groove formed in said one end portion of said elongated portion.

3. An assembly according to claim 1 or 2, wherein said strip has at said free end portion of said second shank an indentation member in the shape of a right-angled dihedron disposed against the bottom portion of the groove of said disk so as to straddle an upstream edge formed by the bottom portion of said groove and a face portion of the disk when the block is in place.

4. An assembly according to claim 1, wherein the first and second shanks of the strip are shaped such that the second shank is positioned on the bottom of the groove of the disk and juts inward in relation to a lower plane of the elongated portion when the second shank of the strip is positioned on said first end of the elongated portion.

5. An assembly according to claim 1, wherein the strip further comprises a boss located adjacent the axle for cooperative engagement with the blade foot.

6. An assembly according to claim 1, wherein the flexible strip has a notch formed on a lower face portion of said free end portion for engaging a device resting on the upper face portion of a front end portion of the elongated portion so as to partially retract inside said second slot of the strip when the block is positioned between the blade foot and said bottom portion of the groove of the disk.

* * * * *